United States Patent [19]

Oldberg

[11] 4,261,307

[45] Apr. 14, 1981

[54] VARIABLE VALVE TIMING CONTROL FOR INTERNAL COMBUSTION ENGINES

[76] Inventor: Sidney Oldberg, 211 Hanshaw Rd., Ithaca, N.Y. 14850

[21] Appl. No.: 72,971

[22] Filed: Sep. 6, 1979

[51] Int. Cl.[3] ..... F01L 1/34

[52] U.S. Cl. ..... 123/90.15; 123/90.16; 123/90.17

[58] Field of Search ..... 123/90.15, 90.16, 90.17, 123/90.21, 127, 321, 346, 347, 348, 311

[56] References Cited

U.S. PATENT DOCUMENTS

| | | | |
|---|---|---|---|
| 1,175,820 | 3/1911 | Rounds | 123/90.15 |
| 1,318,542 | 10/1919 | Chevrolet | 123/90.15 |
| 2,260,983 | 10/1941 | Walker | 123/90.15 |
| 2,266,077 | 12/1941 | Roan | 123/90.15 |
| 2,565,022 | 8/1961 | Hattink | 123/90.15 |
| 2,773,490 | 12/1956 | Miller | 123/311 |
| 2,780,912 | 2/1957 | Miller | 123/60.13 |
| 2,880,711 | 4/1959 | Roan | 123/90.15 |
| 2,880,712 | 4/1959 | Roan | 123/90.15 |
| 2,977,943 | 4/1961 | Lieberherr | 123/90.15 |
| 2,997,991 | 8/1961 | Roan | 123/90.15 |

FOREIGN PATENT DOCUMENTS

| | | | |
|---|---|---|---|
| 2363891 | 7/1975 | Fed. Rep. of Germany | 123/90.15 |
| 633267 | 1/1928 | France | 123/90.22 |
| 2237058 | 2/1975 | France | 123/90.15 |

*Primary Examiner*—Charles J. Myhre
*Assistant Examiner*—R. A. Nelli
*Attorney, Agent, or Firm*—Brumbaugh, Graves, Donohue & Raymond

[57] ABSTRACT

In the particular embodiments of the invention disclosed in the Specification, a variable valve control mechanism for internal combustion engines has a movable element interposed between the inlet valve cam and the inlet valve cam follower which is positioned in such a way as to delay closing of the inlet valve. In one form, a roller is interposed between the cam and the follower. In another form, a rocker arm has two pads, one of which is interposed between the cam and its follower, and the other of which is positioned to displace the rocker arm laterally in accordance with the position of a control arm upon which the rocker arm shaft is movably mounted.

10 Claims, 10 Drawing Figures

VARIABLE VALVE TIMING CONTROL FOR INTERNAL COMBUSTION ENGINES

FIELD OF THE INVENTION

This invention relates to valve control arrangements for internal combustion engines and, more particularly, to a variable valve control mechanism for a spark ignited internal combustion engine which provides substantial improvements in fuel conservation.

Heretofore the valve control arrangements for spark ignited internal combustion engines have generally caused the inlet valve to open and close at the same relative times in the operating cycle of the engine, regardless of the operating load on the engine. As a result, the energy required to pump the inlet fuel charge past the throttle is substantially greater than is necessary under partial load operating conditions. The consequent loss of fuel efficiency has long been recognized, as described for example in Kerley & Thurston, "The Indicated Performance of Otto Cycle Engines." SAE Trans. Vol. 16 (1962) pg. 5; Grish, McCullough, Retzloff & Mueller, "Determination of True Engine Friction"; Roensch, "Thermal Efficiency and Mechanical Losses of Automotive Engines," SAE Trans. Jul. Vol. 51 (1949) pg. 17; and Bishop, "Effect of Design Variables on Friction and Economy," SAE Trans. Vol. 73 (1965) pg. 334. Despite that recognition, a practical solution to the problem of reduced efficiency at partial load has thus far been unavailable to the art.

Accordingly, it is an object of the present invention to provide a new and improved valve control arrangement for internal combustion engines which overcomes the above-mentioned disadvantages of the prior art.

Another object of the invention is to provide a variable control arrangement for internal combustion engines which gives substantially improved operating efficiency under partial load conditions.

BRIEF SUMMARY OF THE INVENTION

To overcome the above-mentioned disadvantages of conventional spark ignited internal combustion engines, this invention provides a variable valve control mechanism arranged to retard the closing of the inlet valve when the engine is operating at partial load, thereby allowing a portion of the fuel-air charge to re-enter the inlet manifold at or near atmospheric pressure and avoiding a significant loss of energy which results from the unnecessary pumping load occuring in convention engines at partial load. In a representative embodiment of the present invention, closing of the inlet valve is retarded by interposing a movable member between the inlet valve cam and its follower and providing an arragement for moving the movable member so as to change the closing time of the inlet valve in response to changes in engine load. One form of movable member in accordance with the present invention comprises a rocker arm pivoted on a member which is shifted by the engine throttle mechanism. A pad mounted on the rocker arm changes the timing of the closing of the inlet valve as the member is shifted.

BRIEF DESCRIPTION OF THE DRAWINGS

In the accompanying drawings.

DESCRIPTION OF THE PREFERRED EMBODIMENTS

As described in the above-cited articles, the major loss of efficiency resulting from pumping the inlet charge past the throttle at partial loads has long been recognized, evaluated and documented. Thermodynamic theory and experimental data show that the thermal efficiency of a spark ignited internal combustion engine is a major function of the expansion rate but is independent of the volume at the beginning of the compression stroke, except as the thermodynamic properties of the burned gases improve slightly the efficiency at part load due to lower temperatures. The present invention takes advantage of these characteristics to provide improved engine operating efficiency and reduced fuel consumption by delaying the closing of the inlet valve during the operating cycle of the engine.

Figure 1:
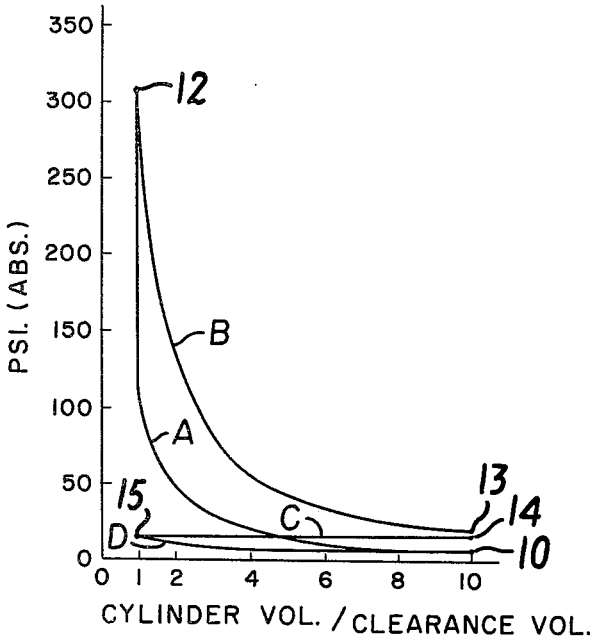
FIG. 1 is a graphical representation showing the pressure-volume diagram of an internal combustion engine having a conventional valve arrangement.

FIG. 1 illustrates graphically the pressure-volume relation during the operating cycle of a typical spark-ignited internal combustion engine in, for example, a medium weight vehicle operating at a speed of 30 miles per hour on a level road and having 10:1 compression ratio. In FIG. 1 the curves designated A, B, C and D illustrate the relation between the absolute pressure in the cylinder and the ratio of cylinder volume to clearance volume during the compression stroke, the power or expansion stroke, the exhaust stroke and the intake stroke of the cylinder, respectively.

As illustrated in FIG. 1, the inlet valve closes at point 10 (shortly after bottom center) when the pressure is very nearly equal to the inlet manifold pressure, i.e. about 5 psia. The charge is then compressed polytropically, following the curve A to about 95 psia, at point 11 where the volume is equal to the clearance volume of the cylinder. The spark then ignites the charge, raising the pressure to a maximum of about 305 psia at the point 12. Polytropic expansion, following the curve B to the point 13, then lowers the pressure to about 18 psia where the exhaust valve opens, decreasing the pressure to atmospheric at the point 14. Upward motion of the piston in the cylinder, with the exhaust valve open, maintains the cylinder at atmospheric pressure, as shown by the curve C, until, at the point 15, the contents of the cylinder, except for the clearance volume, have been exhausted. From the point 15 the cylinder pressure drops to the inlet manifold pressure as the inlet valve opens, and a fresh charge is drawn in at the inlet manifold pressure following the curve E.

The area above the zero pressure line under the curve B represents the work done during the expansion or power stroke, while the area under the curve A between the points 10 and 11 represents the energy absorbed during the compression stroke. The difference between those areas, i.e. the area enclosed by the points 10, 11, 12 and 13, is the developed work expressed as the indicated mean effective pressure (imep). The work expended during the exhaust stroke at substantially atmospheric pressure can be represented by the area under the curve C, with respect to zero pressure, while the area under the curve B represents energy returned to the cycle, with respect to zero pressure, during the intake stroke. The difference between the area under the curve C and that under the curve B, i.e. the area enclosed by the points 14, 15, and 10, is equal to the pump work. The net imep delivered by the piston is the developed imep minus the pump work imep.

To determine the effect of eliminating the pump work from readily available test data, it is only necessary to determine (a) the brake mep required at a given speed from road test data, (b) the friction mep from dynamometer data, (c) the relation of the manifold pressure to delivered imep from dynamometer data, or from the above-described literature references which are in very close agreement under equal values of rpm, fuel air ratio and compression ratio, and (d) the relations of manifold pressure to pump work, which can be measured or taken from the literature. Such determinations also agree with the calculated values. The improvement which can be obtained by eliminating the pump work is then the ratio of the delivered imep (22 psi in the illustrated example) plus pump work (11.6 psi in the illustrated example) which is the imep developed by the piston, to the delivered imep.

Figure 3:
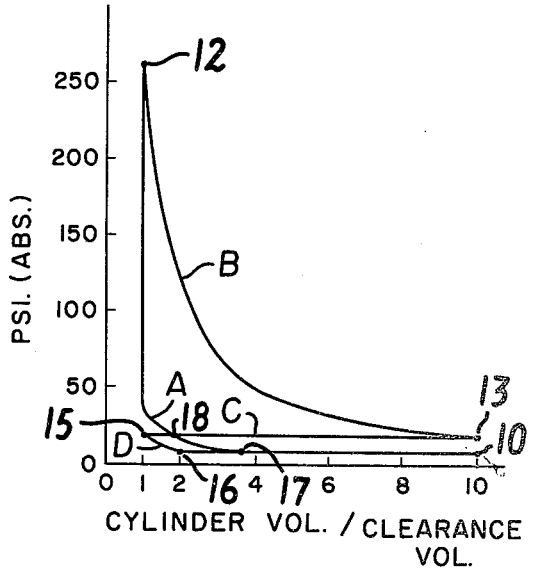
FIG.3 is a graphical representation showing the pressure-volume diagram of an engine having a modified variable valve control arrangement in accordance with the present invention.
Figure 2:
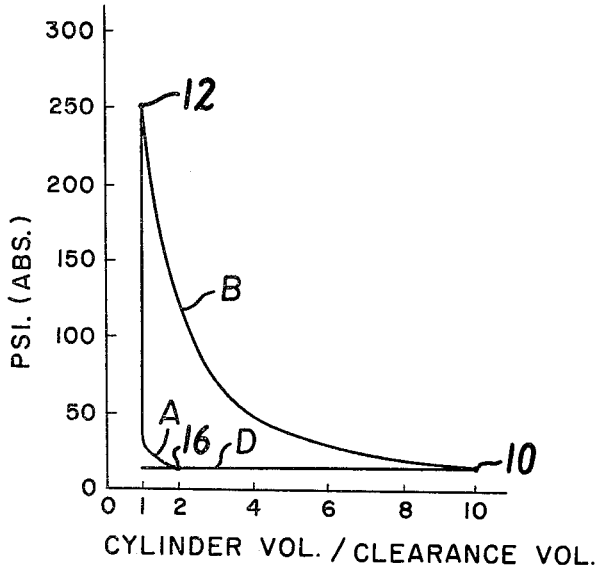
FIG.2 is a graphical representation showing the pressure-volume diagram of an engine having a variable valve control arrangement in accordance with the present invention.

An internal combustion engine operating cycle arranged to eliminate the pumping loss in accordance with the invention is illustrated graphically in FIG. 2. By retarding the closing of the intake valve to the point 16 in the compression stroke A, both the exhaust and inlet strokes take place, for the most part, at or near atmospheric pressure. However, the extent of the delay required for closing of the inlet valve to the point 16 of FIG. 2 adds to the problems of the timing mechanism, and furthermore, the pressure at the end of the expansion or power stroke B becomes subatmospheric at light loads, introducing a slight loss. To avoid such difficulties, while still providing the advantages of the invention, the cycle may be arranged as shown in FIG. 3 to retard the inlet closing to the point 17 on the compression stroke A a maximum of 80 crank degrees, so as to close at about 60 degrees before top center, and reducing the delivered imep to about 42 psi. At lighter loads corresponding to vehicle speeds less than about 30 mph, throttling is employed. As shown in FIG. 3, the intake stroke D is taken at about 5 psi, but 70% of the charge is returned to the inlet manifold during the compression stroke A with negligible change of pressure, hence incurring no loss.

Figure 4:
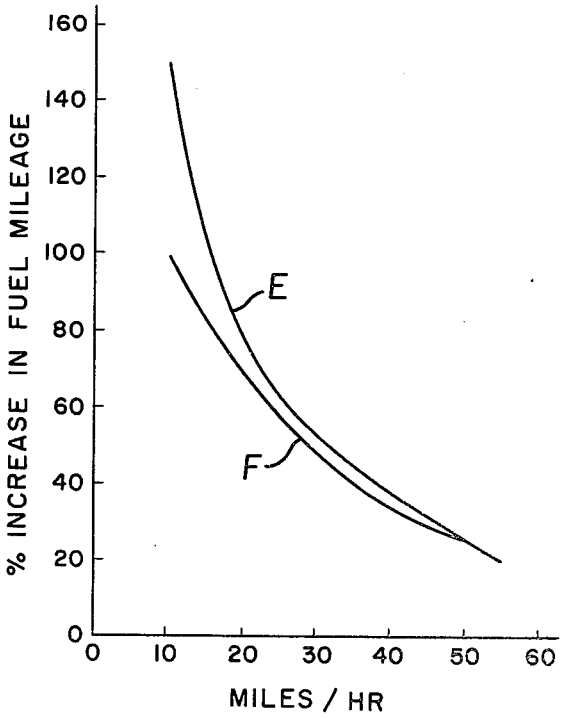
FIG. 4 is a graphical representation illustrating the increase in fuel mileage resulting from complete or partial control of the inlet valve operation in accordance with the present invention.

After the valve closes at the point 17, the compression ratio is low enough that the negative work represented by the area between the curves A, C and D (enclosed by the points 15, 16, 17 and 18) corresponds to about 1.1 psi in the illustrated example, which is about 10% of the conventional pump work. The increase in fuel mileage of a typical vehicle resulting from such elimination of pump work, based on the data reported in the above cited references, is shown in FIG. 4. That graphical representation illustrates the relation between the vehicle speed and the increase in fuel mileage for an operating cycle of the type shown and described with respect to FIG. 2 (curve E) and for an operating cycle of the type shown and described with respect to FIG. 3 (curve F).

Figure 5:
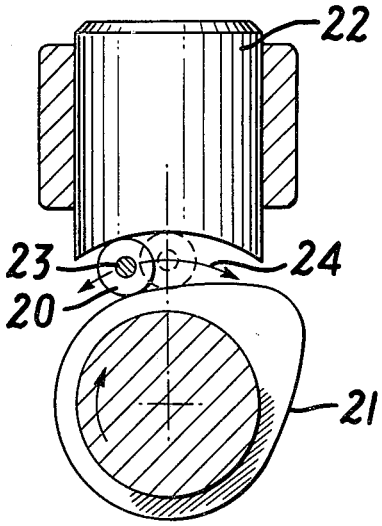
FIG. 5 is a fragmentary side view of one form of variable valve control mechanism arranged in accordance with the present invention.

A representative arrangement for controlling the valve operation in accordance with the present invention is shown schematically in FIG. 5. In that arrangement, a roller 20 is inserted between an inlet valve cam 21 and an inlet cam follower 22. The roller 20, supported on a shaft 23, is movable in an arc 24 about the center of the cam 21 and engages a corresponding arcuate surface of the follower 22. By moving the shaft 23 along its arcuate path 24, the timing of the operation of the inlet valve with respect to the cam cycle can be varied.

It is evident that if the roller 20 is at a point ahead of the center line between the cam 21 and the follower 22 at the instant of valve closing, the inlet valve will close earlier, whereas if the roller 20 is at a point on the other side of the center line between the cam and the follower, the inlet valve will close later. This is the principal employed in variable valve control mechanisms in accordance with the present invention.

In addition to retarding the inlet valve closing by employing a standard cam contour and positioning the roller 20 at the required position, the invention may also be carried out by employing a cam whose duration of opening is increased by the maximum desired angle of retarded closing and advancing the follower 20 during opening, ultimately by an amount sufficient to obtain normal timing for the valve opening, or by using a partially extended cam and employing both advance and retard capability.

Figure 6:
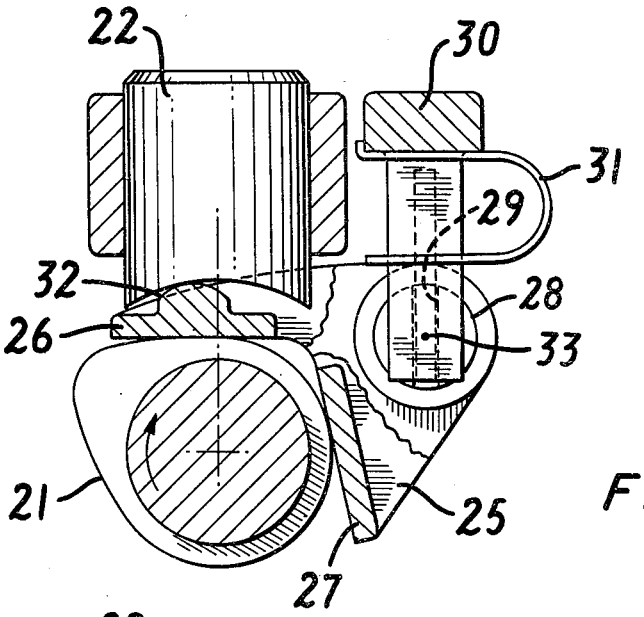
FIG. 6 is a fragmentary side view showing another form of variable valve control mechanism arranged in accordance with the present invention.

Considerations of space, dynamics and force tend to favor the latter option. Moreover, if the cam contour is normal on the valve opening side and the duration of valve opening is extended, advancing the roller 20 by an amount equal to this extension during valve opening will result in normal time of closing. The motion is slightly distorted, but this may be compensated by the contour design of the cam To provide an arrangement permitting both advance and retard capability, the mechanism shown in FIG. 6 is utilized. In that mechanism, an auxiliary rocker arm 25 carries a main pad 26 and an auxiliary pad 27 engaging the surface of the cam 21 at two locations spaced by approximately 103°. For this purpose, the rocker arm 25 is pivotally supported on a shaft 28 carried for longitudinal motion in a slot 29 in a control arm 30 which is movable about a fixed center 33 and a spring 31 urges the shaft 28 toward the end of the control arm slot closet to the cam 21. The main pad 26 transmits motion from the cam surface to the follower 22, while the auxiliary pad 27 actuates a timing control arrangement for the variable valve mechanism. The pad 26 includes a projecting surface 32 which engages the arcuate surface of the follower 22 at a location which is dependent upon the angular position of the support shaft 28 with respect to the center of the cam 21. When the pads 26 and 27 both contact the base circle, the center of the shaft 28 is coincident with the center 33 or control shaft 30 and the main pad is at right angles to the center line between the cam 21 and the follower 22.

Figure 7:
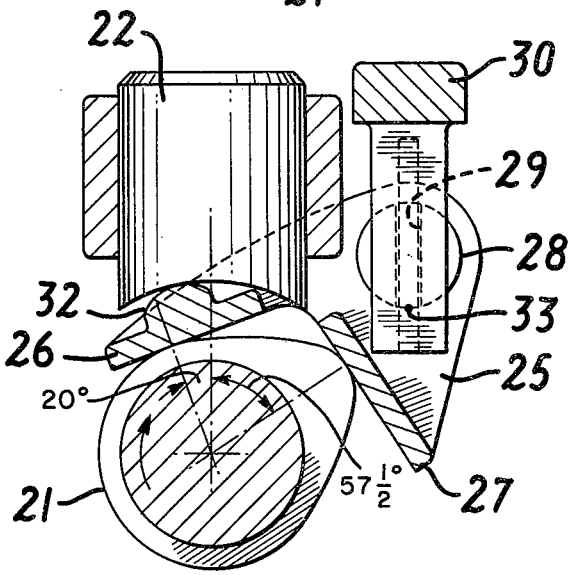
FIGS. 7, 8, and 9 illustrate the variable valve control mechanism of FIG. 6 at the instant of inlet valve closing under three different control conditions.
Figure 8:
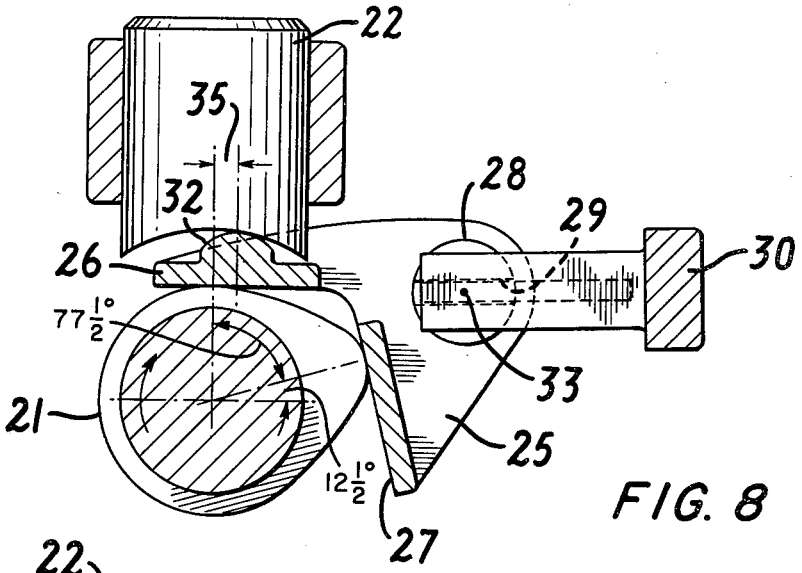
Figure 9:
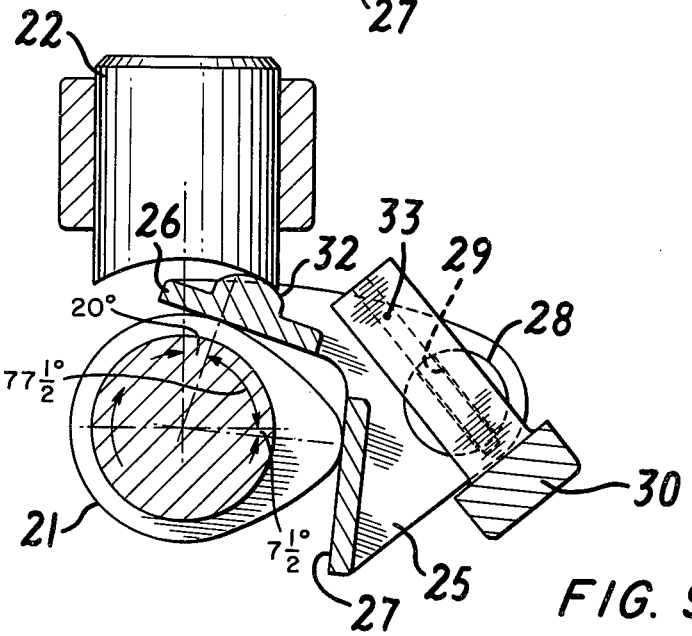

FIG. 7 illustrates the relative positions of the basic components of the mechanism shown in FIG. 6 at the time of closing of the inlet valve to provide normal timing for maximum torque, the main pad 26 being positioned 20° ahead of the center line between the cam 21 and the follower 22. FIG. 8 shows the relative positions of the same components with the mechanism set to close the inlet valve 20° later in the cam cycle, and FIG. 9 illustrates the relative positions of the same components at the instant of inlet valve closing with the mechanism arranged to close the inlet valve 40° later than normal for maximum efficiency under minimum load conditions. In each instance, the cam which actuates the main pad 26 also actuates the auxiliary pad 27 in such manner as to move the shaft 28 to an appropriate position in the slot 29 to move the main pad 26 laterally away from the center line between the cam 21 and the follower 22 so as to postpone the inlet valve closing by an appropriate amount.

Figure 10:
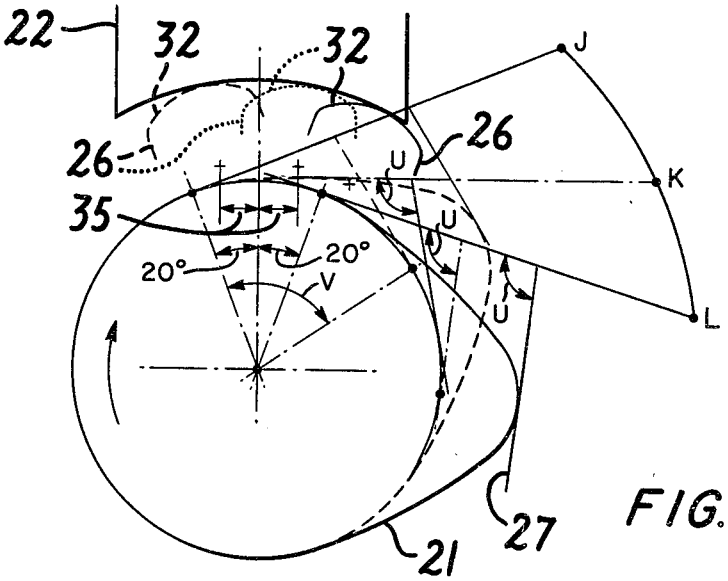
FIG 10 is a schematic illustration showing the geometric relations of certain of the elements of the valve control mechanism of FIGS. 7–9 at critical points in the operating cycle.

FIG. 10 shows schematically the geometry of the system illustrated in FIG. 6 at the point of inlet valve closing for the three different positions of the control arm 30 shown in the FIGS. 7, 8 and 9. In this connection, it should be noted that: (1) If the angle U subtended between the two rocker arm pads 26 and 27 equals 180° minus the angle V, which is the cam angle between the maximum lift and the point of closing, maximum translation of the main pad 26 always occurs at the point of closing. (2) The locus of the points J, K and L, representing the position of the shaft 28 at its maximum rocker motion, is a circular arc concentric with the axis of the cam 21. (3) The rocker motion has two components, (a) a rotary motion in either direction determined by the control arm position, and (b) translation to the right on a line tangent to the contact between the main pad 26 and the cam 21 at the instant of closing, which is equal in all positions to the amount of cam lift. This translation could result in serious limitations if it were allowed to affect the angular position of the main pad 26. For example, if the roller 20 shown in FIG. 5 were employed, its translation would greatly diminish its range of adjustment. It is therefore necessary to employ only the rotating component of the rocker motion. This can be done by using the flat faced main pad 26 with its projecting arcuate surface 32 in contact with the follower surface, which is concentric with the cam axis when seated. The translational component of the rocker motion is seen to be eliminated from affecting the follower motion by sliding on the cam surface in the direction of translation without rotation of the main pad 26. (4) Constant follower clearance at the opening and seating of the inlet valve requires that the follower position be the same at the beginning of the rocker motion and when at the position of maximum translation, which is also the point of valve closing. This requirement is achieved if the projecting arc 32 of the main pad 26 is displaced by one half the cam lift in the direction of cam rotation when the rocker is in its seated position, as represented by the displacement 35 shown in FIG. 8.

In operation, the main pad 26 is always horizontal at the beginning of the intake stroke, as shown in FIG. 6. When the control arm 31 is in the position shown in FIG. 6, it constrains the shaft 28 to vertical motion, as indicated in FIG. 7, at the time of inlet valve closing. As a result, the follower 22 is held in a partially open position through the vertical motion of the main pad 26 until the required time for inlet valve closing, which occurs when the pad is 20° to the left of the center line between the cam 21 and the follower 22. The auxiliary pad 27 has caused the rocker arm 25 to rotate in the direction opposite to the cam rotation, so that when the valve closes, the main pad 26 has moved a maximum amount to the left of the center line, and the rocker arm has moved in a direction perpendicular to the main pad in an equal amount, and its center has moved one half the follower stroke to the right of the radius vector to the cam contact point.

With the control arm 30 in the horizontal position shown in FIG. 8, the shaft 28 is confined to horizontal motion, so that the main pad 26 is horizontal at the opening and closing points of the valve, and the delay in closing is that which results from the 20° shift in the cam timing. Further clockwise motion of the control arm 30 to the position shown in FIG. 9 retards closing of the valve even further, since the main pad 26 is farther to the right at the point of valve closing, whereas the clearance between the follower 22 and the cam 21 is constant.

Although the invention has been described herein with reference to specific embodiments, many modifications and variations will readily occur to those skilled in the art. All such variations and modifications are included within the scope of the invention, as set forth in the following claims.

I claim:

1. A variable valve control for internal combustion engines comprising an inlet valve cam, an inlet valve cam follower, a movable member disposed between the inlet valve cam and the inlet valve cam follower including a first cam-engaging element engaging a first surface portion of the inlet valve cam, and means including a second cam-engaging element engaging a second surface portion of the inlet valve cam angularly spaced from the first surface portion for moving the movable member between the inlet valve cam and the inlet valve cam follower so as to alter the timing of the inlet valve operation.

2. A variable valve control according to claim 1 wherein the means for moving the movable member is adjustable to position the movable member to delay the closing of the inlet valve until after the compression stroke of the engine has started, thereby reducing the intake pumping work.

3. A variable valve control according to claim 2 wherein the means for moving the movable member is adjustable to permit the closing time of the inlet valve to be increased by about 40°.

4. A variable valve control according to claim 1 in which the means for moving the movable member is arranged to move the movable member during the time when the inlet valve is open so as to delay closing of the inlet valve.

5. A variable valve control according to claim 1 in which the movable member comprises a first pad interposed between the inlet valve cam and the inlet valve cam follower and supported on a rocker arm and the means for moving the movable member comprises a second pad supported on the rocker arm to engage the inlet valve cam surface at a different angular position.

6. A variable valve control according to claim 5 including a support shaft for the rocker arm and a control arm receiving the support shaft for longitudinal motion therein.

7. A variable valve control according to claim 6 wherein the control arm is mounted for angular motion with respect to the inlet valve cam so as to alter the direction of motion of the support shaft.

8. A variable valve control according to claim 6 including spring means for urging the shaft toward the end of the slot in the control arm adjacent to the inlet valve cam surface.

9. A variable valve control according to claim 5 wherein the angle between the first and second pads with respect to the cam axis is equal to 180° minus the cam angle between the maximum valve lift point and the closing point.

10. A variable valve control according to claim 5 wherein the first pad has a flat face engaging the inlet valve cam surface and an arcuate face engaging the inlet valve cam follower surface.

* * * * *